US008649702B2

(12) United States Patent
Nakamura

(10) Patent No.: US 8,649,702 B2
(45) Date of Patent: Feb. 11, 2014

(54) ELECTROSTATIC CHARGER DEVICE AND IMAGE FORMING APPARATUS

(75) Inventor: Ginga Nakamura, Osaka (JP)

(73) Assignee: Sharp Kabushiki Kaisha, Osaka (JP)

( * ) Notice: Subject to any disclaimer, the term of this patent is extended or adjusted under 35 U.S.C. 154(b) by 392 days.

(21) Appl. No.: 13/180,703

(22) Filed: Jul. 12, 2011

(65) Prior Publication Data

US 2012/0027452 A1 Feb. 2, 2012

(30) Foreign Application Priority Data

Jul. 29, 2010 (JP) ..... 2010-170662

(51) Int. Cl.
*G03G 21/00* (2006.01)
*G03G 15/02* (2006.01)

(52) U.S. Cl.
CPC ..... *G03G 15/0291* (2013.01); *G03G 15/0258* (2013.01)
USPC ..... 399/99; 399/100

(58) Field of Classification Search
USPC ..... 399/99, 100, 107
See application file for complete search history.

(56) References Cited

U.S. PATENT DOCUMENTS 3,875,407 A * 4/1975 Hayne ..... 399/100
7,769,313 B2 * 8/2010 Matsuyama et al. ..... 399/100

FOREIGN PATENT DOCUMENTS

JP 02205870 A * 8/1990
JP 10-078692 3/1998
JP 2003-233244 8/2003
JP 2009-205043 9/2009

* cited by examiner

*Primary Examiner* — Walter L Lindsay, Jr.
*Assistant Examiner* — Matthew Miller
(74) *Attorney, Agent, or Firm* — Renner, Otto, Boisselle & Sklar, LLP

(57) ABSTRACT

An electrostatic charger device according to this invention includes a cleaner member, an operating rod, a guide portion, and a bending member. The cleaner member is configured to clean an electrode housed in a housing by pressing against the electrode. The operating rod has one end in a longitudinal direction to which the cleaner member is fixed. The guide portion is disposed at one end of the housing in a primary scanning direction and has a through-hole through which the operating rod extends in the longitudinal direction, the guide portion supporting the operating rod to enable the cleaner member to reciprocate between a first position and a second position. The bending member is configured to bend the operating rod in such a manner that an intermediate portion of the operating rod projects away from an image bearing member when the cleaner member is in the first position.

10 Claims, 7 Drawing Sheets

ELECTROSTATIC CHARGER DEVICE AND IMAGE FORMING APPARATUS

CROSS REFERENCE

This Nonprovisional application claims priority under 35 U.S.C. §119(a) on Patent Application No. 2010-170662 filed in Japan on Jul. 29, 2010, the entire contents of which are hereby incorporated by reference.

BACKGROUND OF THE INVENTION

The present invention relates to an electrostatic charger device for electrostatically charging an image bearing member in an image forming apparatus configured to perform electrophotographic image formation and, more particularly, an electrostatic charger device provided with a cleaner member for cleaning a surface of an electric discharge member. The present invention also relates to an image forming apparatus incorporating such an electrostatic charger device.

Electrostatic charger devices include an electrostatic charger for electrostatically charging a photoreceptor drum as an image bearing member, an electrostatic pre-charger for imparting electrostatic charge to a toner image on an intermediate transfer belt as an image bearing member, and like electrostatic chargers. Such an electrostatic charger device has an electric discharge member such as a discharge wire or a plate-shaped electrode. The electrostatic charging efficiency of such an electric discharge device decreases as the surface of the electric discharge device becomes stained by toner on an image bearing member at every discharge. In order to prevent the electrostatic charging efficiency from decreasing, the electrostatic charger device needs to clean the surface of the electric discharge member.

Among conventional electrostatic charger devices there is an electrostatic charger device of the type which includes an operating rod having one end provided with a cleaner member m formed of CR rubber (chloroprene rubber), urethane foam, or the like and the other end provided with a handle, as disclosed in Japanese Patent Laid-Open Publication No. H10-078692. The operating rod is capable of reciprocating the cleaner member along the electric discharge member while pressing the cleaner member against the electric discharge member. By reciprocating the operating rod along the electric discharge member, the cleaner member cleans the surface of the electric discharge member.

When formed of a resin wire material or a metal wire material having a small sectional area for cost reduction or size reduction, however, the operating rod has a lowered rigidity and hence is easily bent by the operating force exerted for reciprocal movement. When the operating rod is bent toward the image bearing member and brought into contact with the image bearing member, the operating rod damages the surface of the image bearing member.

A feature of the present invention is to provide an electrostatic charger device which fails to damage the surface of the image bearing member even when the operating rod has a lowered rigidity, as well as an image forming apparatus incorporating such an electrostatic charger device.

SUMMARY OF THE INVENTION

An electrostatic charger device according to the present invention includes a cleaner member, an operating rod, a guide portion, and a bending member. The cleaner member is configured to clean an electrode housed in a housing by pressing against the electrode. The operating rod has one end in a longitudinal direction to which the cleaner member is fixed. The guide portion is disposed at one end of the housing in a primary scanning direction and has a through-hole through which the operating rod extends in the longitudinal direction, the guide portion supporting the operating rod to enable the cleaner member to reciprocate between a first position and a second position. The bending member is configured to bend the operating rod in such a manner that an intermediate portion of the operating rod projects away from an image bearing member when the cleaner member is in the first position.

DETAILED DESCRIPTION OF THE INVENTION

Hereinafter, an image forming apparatus incorporating an electrostatic charger device according to an embodiment of the present invention will be described with reference to the attached drawings.

Figure 1:
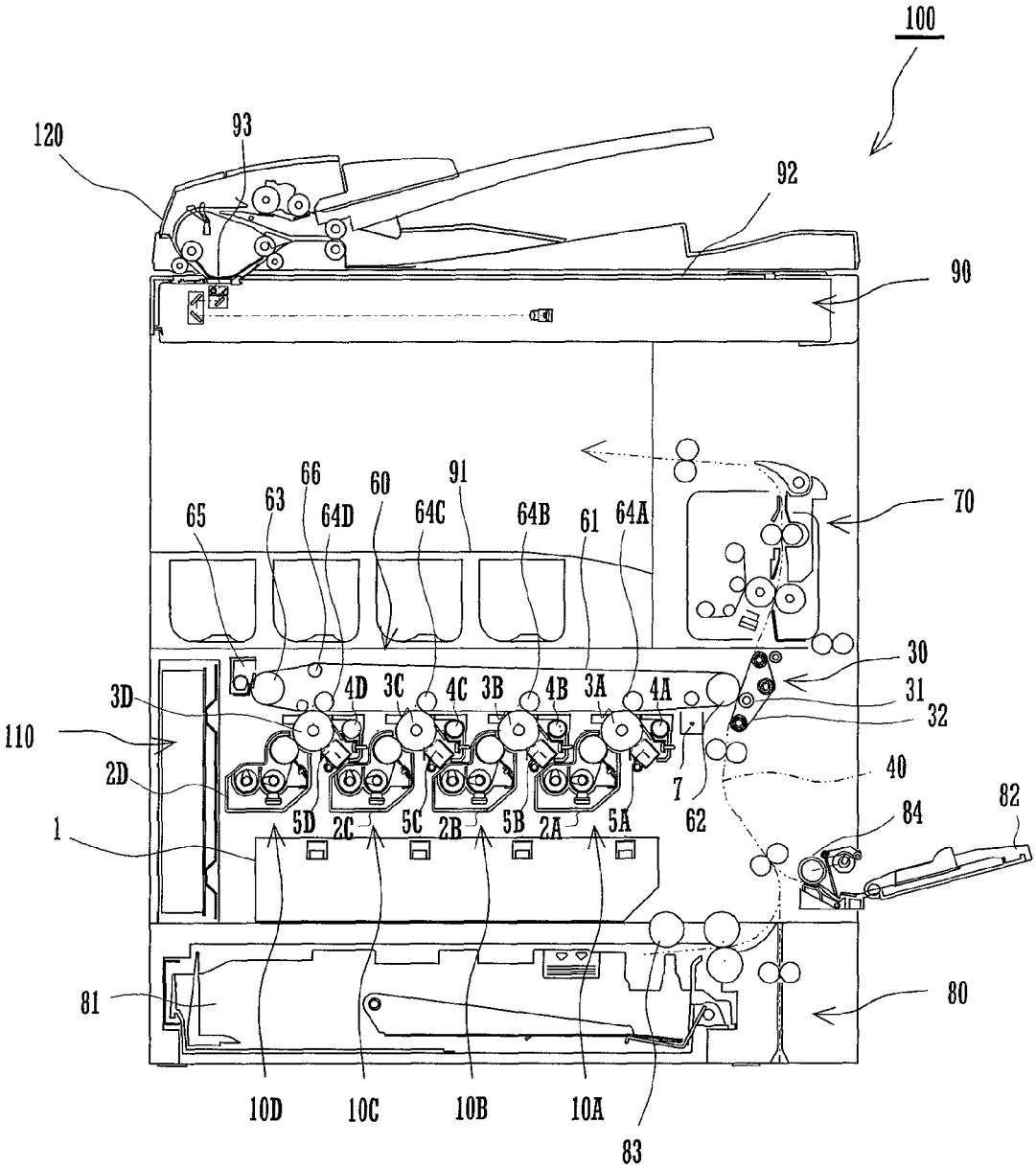
FIG. 1 is a sectional front elevational view schematically illustrating an image forming apparatus.

Referring to FIG. 1, an image forming apparatus 100 includes a sheet feeding section 80, an image reading section 90 and an image forming section 110 and is configured to form a polychrome or monochrome image on a recording sheet according to image data read from a document. The image forming apparatus 100 may be configured to perform image formation according to image data inputted thereto from an external device.

The image reading section 90 is configured to read image data from a document being automatically fed over a document platen 93 by the document feeding function of an automatic document feeder 120 or a document manually placed on the document platen 92 by an operator pivoting the automatic document feeder 120 to open and close the document platen 92.

The image forming section 110 includes an exposure unit 1, image forming units 10A to 10D, an intermediate transfer unit 60, a secondary transfer unit 30, and a fixing unit 70.

The image forming unit 10A includes a developing device 2A, a photoreceptor drum 3A, a cleaner device 4A, and an electrostatic charger 5A and is configured to form a black image. The electrostatic charger 5A is configured to electrostatically charge the surface of the photoreceptor drum 3A to a predetermined potential uniformly. The developing device 2A is configured to visualize an electrostatic latent image formed on the photoreceptor drum 3A into a black toner image. The cleaner device 4A is configured to recover residual toner remaining on the peripheral surface of the photoreceptor drum 3A. The image forming units 10B to 10D have the same configuration as the image forming unit 10A and are configured to form a cyan image, a magenta image and a yellow image, respectively.

The exposure unit 1 is a laser scanning unit comprising optical components such as a semiconductor laser, a polygon mirror, an fθ lens, and a reflecting mirror. The exposure unit 1 is configured to expose the photoreceptor drums 3A to 3D of the respective image forming units 10A to 10D to laser beams modulated according to image data items corresponding to black, cyan, magenta and yellow and scans the surfaces of the respective photoreceptor drums 3A to 3D axially to form respective electrostatic latent images thereon. The direction in which the surfaces of the respective photoreceptor drums 3A to 3D are scanned by exposure, that is, the axial direction of the photoreceptor drums 3A to 3D, is a primary scanning direction.

The intermediate transfer unit 60 includes an intermediate transfer belt 61, a driving roller 62, a driven roller 63, primary transfer rollers 64A to 64D, a cleaning device 65, a tension roller 66, and an electrostatic pre-charger 7. The intermediate transfer belt 61 is an endless belt entrained about the driving roller 62, driven roller 63 and tension roller 66.

The image forming units 10A to 10D are disposed outside the moving path of the intermediate transfer belt 61, while the primary transfer rollers 64A to 64D disposed inside the moving path of the intermediate transfer belt 61. The primary transfer rollers 64A to 64D are associated with the image forming units 10A to 10D, respectively, and are opposed to the respective photoreceptor drums 3A to 3D across the intermediate transfer m belt 61. The primary transfer rollers 64A to 64D act to transfer toner images formed on the peripheral surfaces of the respective photoreceptor drums 3A to 3D onto the surface of the intermediate transfer belt 61.

The electrostatic pre-charger 7 is located downstream of the primary transfer rollers 64A to 64D and upstream of the secondary transfer unit 30. The electrostatic pre-charger 7 is configured to impart the toner image on the intermediate transfer belt 61 with electrostatic charge having the same polarity as the electrostatic charge of the toner prior to the secondary transfer.

The secondary transfer unit 30 includes a secondary transfer roller 31 and a secondary transfer belt 32. The secondary transfer belt 32 is an endless belt entrained about a plurality of rollers including the secondary transfer roller 31. The secondary transfer roller 31 and the driving roller 62 nip the secondary transfer belt 32 and the intermediate transfer belt 61 therebetween.

In color image formation, black, cyan, magenta and yellow toner images are sequentially transferred to the same position on the surface of the intermediate transfer belt 61 as the intermediate transfer belt 61 passes over the image forming units 10A to 10D sequentially, to form a color image by subtractive color mixture. In monochrome image formation, a black toner image is transferred onto the surface of the m intermediate transfer belt 61 when the intermediate transfer belt 61 passes over the image forming unit 10A.

The secondary transfer unit 30 is configured to transfer the toner image from the surface of the intermediate transfer belt 61 onto a recording sheet. The cleaning device 65 is configured to recover residual toner remaining on the surface of the intermediate transfer belt 61.

The fixing unit 70 is configured to heat and pressurize the recording sheet that bears the toner image transferred thereto by its passage between the intermediate transfer belt 61 and the secondary transfer roller 31, thereby fixing the toner image to the surface of the recording sheet firmly. The recording sheet having passed through the fixing unit 70 is outputted to a sheet catch tray 91 disposed above the image forming section 110.

The sheet feeding section 80 includes a sheet feed cassette 81 and a manual feed tray 82. The sheet feed cassette 81 has accommodated therein a plurality of recording sheets to be used for printing and is disposed below the exposure unit 1. The manual feed tray 82 is fitted on a lateral side of the image forming apparatus 100. The sheet feeding section 80 is configured to feed recording sheets one by one from the sheet feed cassette 81 or the manual feed tray 82 into a sheet feed path 40 by rotation of a pickup roller 83 or 84. The sheet feed path 40 is formed to extend from the sheet feeding section 80 up to the sheet catch tray 91 by passing between the intermediate transfer belt 61 and the secondary transfer unit 30 and through the fixing unit 70.

Figure 2A:
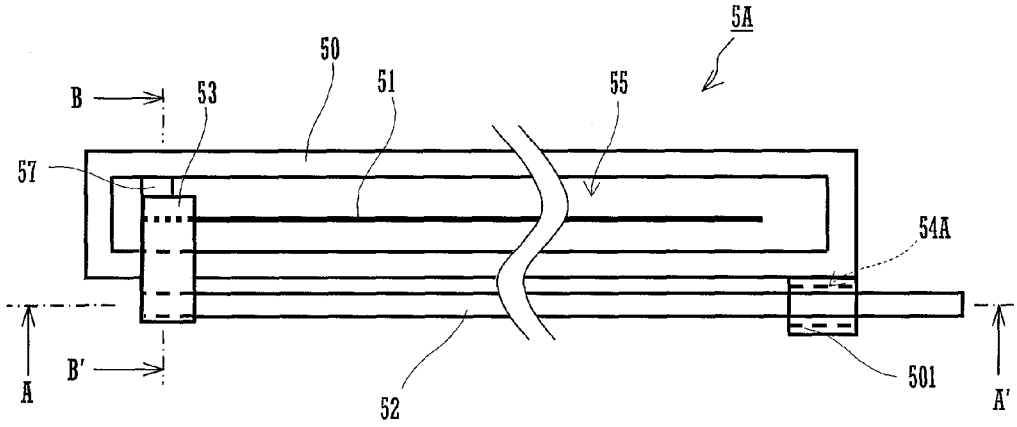
FIGS. 2A to 2C are a plan view, a sectional side elevational view and a sectional front elevational view, respectively, of an electrostatic charger device according to a first embodiment of the present invention.
Figure 2B:
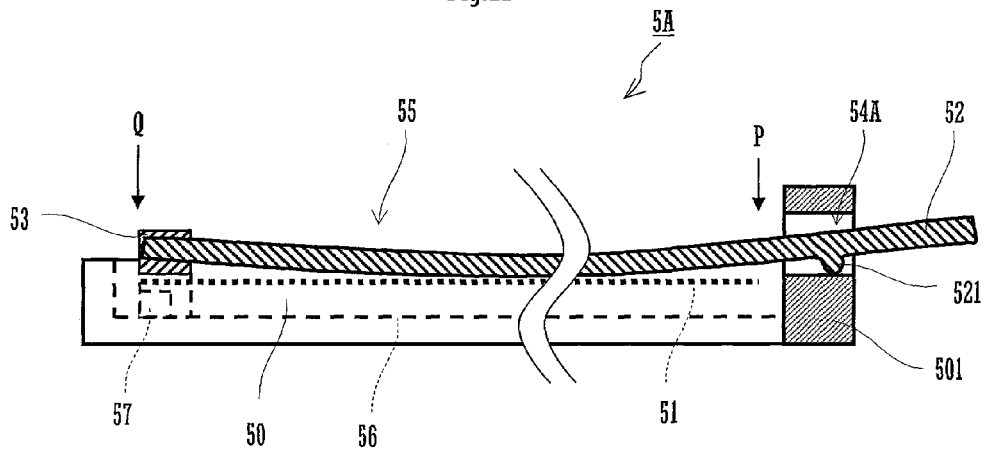
Figure 2C:
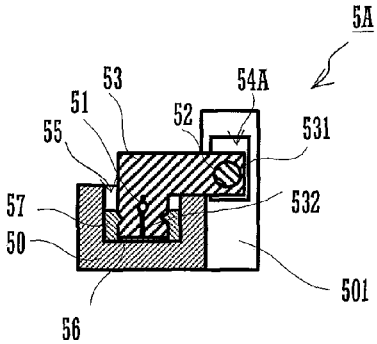

Referring to FIGS. 2A to 2C, the electrostatic charger 5A according to a first embodiment of the present invention is a corona discharger including a housing 50, a discharge wire 51 (which is equivalent to the "electrode" defined by the present invention), and an operating rod 52. FIG. 2A is a plan view of the electrostatic charger 5A. FIG. 2B is a sectional side elevational view taken on line A-A' of FIG. 2A. FIG. 2C is a sectional front elevational view taken on line B-B' of FIG. 2A. The "electrode" defined by the present invention is not limited to such a discharge wire, but may be a plate-shaped electrode.

As shown in FIG. 2B, the housing 50 is shaped into a rectangular parallelepiped having a top surface formed with an opening 55. The housing 50 is disposed adjacent the photoreceptor drum 3A in such a manner that the opening 55 faces the photoreceptor drum 3A. The housing 50 stretches the discharge wire 51 in a direction parallel with the axial direction of the photoreceptor drum 3A. The opposite ends of the discharge wire 51 in the axial direction of the photoreceptor drum 3A correspond to the first position Q and the second position P", respectively, of a cleaner member 53 to be described later.

The housing 50 has a guide portion 501 at a sidewall on the second position P side in the primary scanning direction (see FIG. 2A). The guide portion 501 is formed with a through-hole 54A extending parallel with the axial direction of the photoreceptor drum 3A. The through-hole 54A has a rectangular section that is larger than the section of the operating rod 52.

The operating rod 52 is a member having a circular section and formed of resin, thin metal or the like. The operating rod has a low rigidity and hence can bend when subjected to pressing force. The operating rod 52 may have a polygonal section, but can bends more easily as its sectional shape approximates to a circular shape.

The cleaner member 53 is fixed to one longitudinal end of the operating rod 52. The cleaner member 53 is formed of, for example, CR rubber, urethane foam, or a like material having high flexibility. As shown in FIG. 2C, the cleaner member 53 is formed with a hole 531 which is slightly smaller than the sectional shape of the operating rod 52. The longitudinal end of the operating rod 52 is fitted into the hole 531 to fix the cleaner member 53 thereto. The cleaner member 53 has a bottom surface formed with a slit 532. The cleaner member 53 presses against a surface of the discharge wire 51 by fitting the slit 532 over the discharge wire 51. The bottom surface of the cleaner member 53 abuts against a bottom surface 56 of the housing 50. By operating the operating rod 52, the cleaner member 53 is reciprocated between the second position P close to the guide portion 501 and the first position Q remote from the w guide portion 501 along the bottom surface 56 while pressing against the surface of the discharge wire 51.

The housing 50 is provided at the first position Q with a restriction member 57 for restricting movement of the cleaner member 53 toward the opening 55 side. The restriction member 57 comprises a pair of plate members extending parallel with the axial direction of the photoreceptor drum 3A. In front view, the pair of plate members stand upright from the bottom surface 56 on the opposite sides of the discharge wire 51, as shown in FIG. 2C. The restriction member 57 can hold the cleaner member 53 between the pair of plate members each formed with a projection.

As shown in FIG. 2B, the operating rod 52 is formed integrally with a projection 521 (which is equivalent to the "first projection" defined by the present invention) at that portion which is positioned within the through-hole 54 when the cleaner member 53 is in the first position Q.

In cleaning the discharge wire 51, the operating rod 52 is operated to reciprocate the cleaner member 53 between the second position P and the first position Q. That portion of the operating rod 52 which is positioned within the through-hole 54A when the cleaner member 53 is in the first position Q, is inclined obliquely downward as it extends in the direction toward the first position Q, so that the operating rod 52 bends to project toward the bottom surface 56. That portion of the operating rod 52 which is positioned within the through-hole 54A when the cleaner member 53 is not in the first position Q, extends substantially parallel with the axial direction of the photoreceptor drum 3A, so that the operating rod 52 fails to bend. Therefore, the operating rod 52 fails to come into contact with the photoreceptor drum 3A during cleaning of the discharge is wire 51 and hence fails to damage the surface of the photoreceptor drum 3A.

Electrostatic chargers 5B to 5D and electrostatic pre-charger 7 are similar in configuration to the electrostatic charger 5A. Accordingly, the electrostatic chargers 5B to 5D and the electrostatic pre-charger 7 fail to allow their respective operating rods 52 to come into contact with their associated photoreceptor drums 3B to 3D and the intermediate transfer belt 61 and hence fail to damage the surfaces of the photoreceptor drums 3B to 3D and the surface of the intermediate transfer belt 61.

In the direction from the opening 55 side toward the bottom surface 56 side, the through-hole 54A may have a slightly larger sectional size than the sectional size of that portion of the operating rod 52 which is inclusive of the projection 521. With such an arrangement, movement of the cleaner member 53 toward the opening 55 side can be restricted and, hence, the restriction member 57 can be eliminated.

Figure 3A:
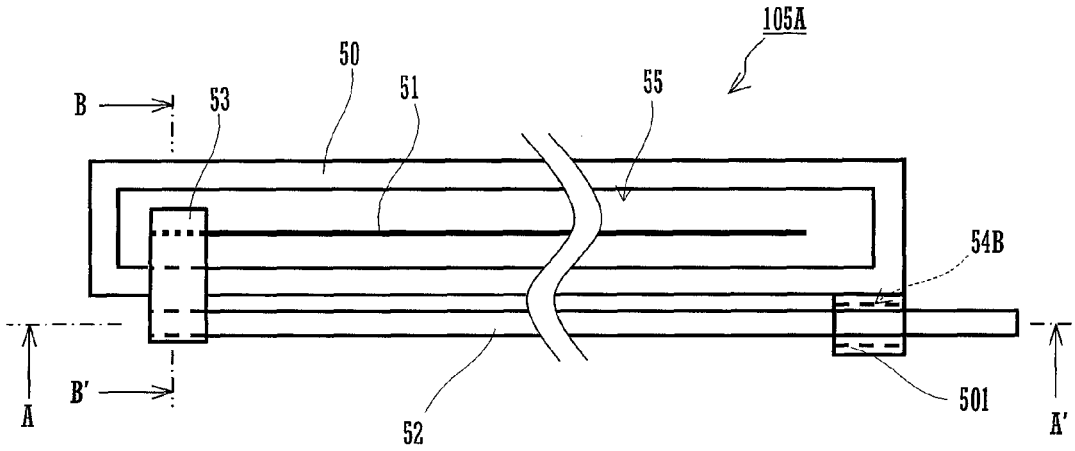
FIGS. 3A to 3C are a plan view, a sectional side elevational view and a sectional front elevational view, respectively, of an electrostatic charger device according to a second embodiment of the present invention.
Figure 3B:
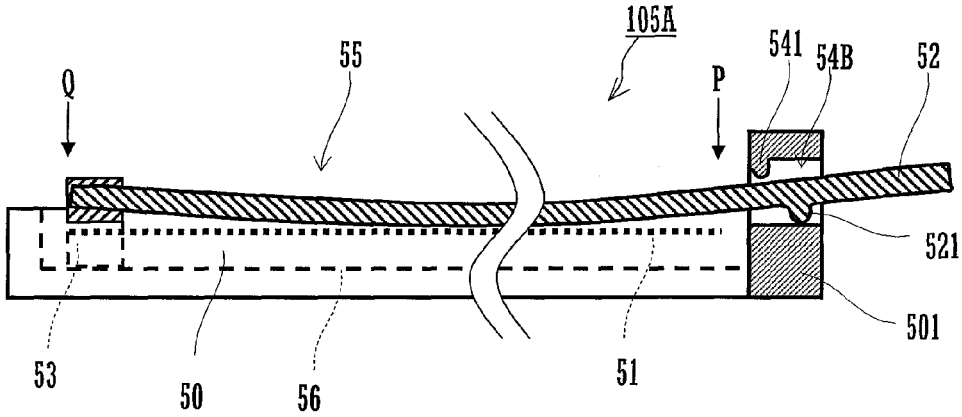
Figure 3C:
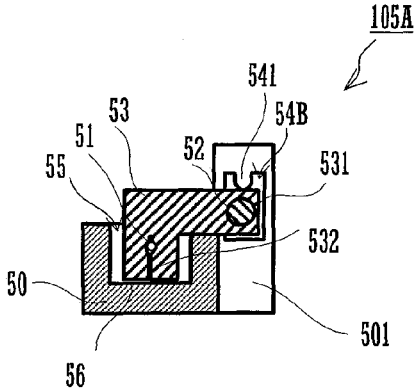

Referring to FIGS. 3A to 3C, an electrostatic charger 105A according to a second embodiment is different from the electrostatic charger 5A in that the electrostatic charger 105A has a through-hole 54B which is different in shape from the through-hole 54A and is not provided with the restriction member 57. The following description is directed only to the differences from the electrostatic charger 5A. FIG. 3A is a plan view of the electrostatic charger 105A. FIG. 3B is a sectional side elevational view taken on line A-A' of FIG. 3A. FIG. 3C is a sectional front elevational view taken on line B-B' of FIG. 3A.

The through-hole 54B extends parallel with the axial direction of the photoreceptor drum 3A. The through-hole 54B has a rectangular section that is larger than the sectional shape of the operating rod 52. The through-hole 54B has an internal surface formed with a projection 541 (which is equivalent to the "second projection" defined by the present invention) which projects from a portion of the internal surface located close to the opening 55 toward the bottom surface 56 side. When the cleaner member 53 is in the first position Q, the projection 541 is positioned closer to the photoreceptor drum 3A and closer to the opening 55 than the projection 521 (which is equivalent to the "third projection" defined by the present invention) of the operating rod 52.

In cleaning the discharge wire 51, that portion of the operating rod 52 which is positioned within the through-hole 54B when the cleaner member 53 is in the first position Q, is reliably inclined obliquely downward as it extends in the direction toward the first position Q, so that the operating rod 52 bends to project toward the bottom surface 56. That portion of the operating rod 52 which is positioned within the through-hole 54B when the cleaner member 53 is not in the first position Q, extends substantially parallel with the axial direction of the photoreceptor drum 3A or obliquely downward as it extends in the direction toward the first position Q, so that the operating rod 52 extends parallel with the axial direction of the photoreceptor drum 3A or bends to project toward the bottom surface 56. Therefore, the operating rod 52 fails to come into contact with the photoreceptor drum 3A and hence fails to damage the surface of the photoreceptor drum 3A.

Figure 4A:
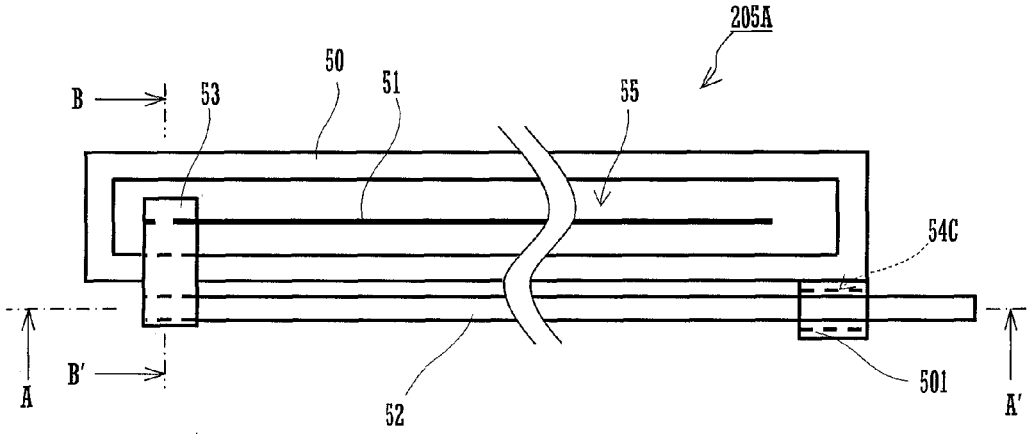
FIGS. 4A to 4C are a plan view, a sectional side elevational view and a sectional front elevational view, respectively, of an electrostatic charger device according to a third embodiment of the present invention.
Figure 4B:
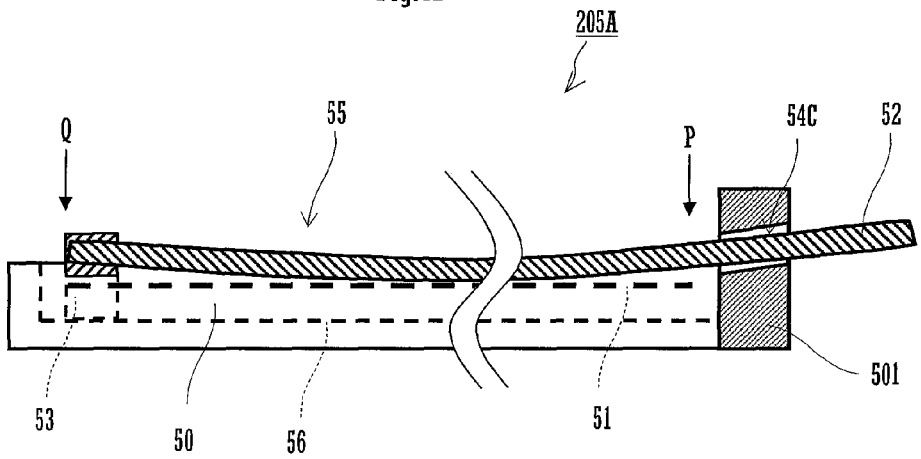
Figure 4C:
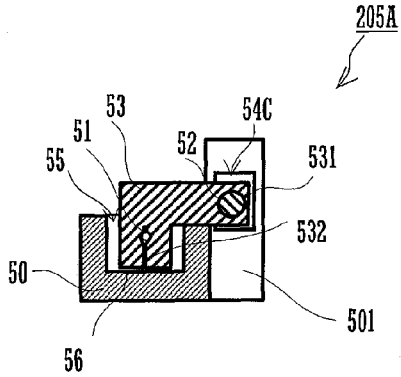

Referring to FIGS. 4A to 4C, an electrostatic charger 205A according to a third embodiment is different from the electrostatic charger 5A in that the electrostatic charger 205A has a through-hole 54C which is different in shape from the through-hole 54A and is not provided with the restriction member 57. The following description is directed only to the differences from the electrostatic charger 5A. FIG. 4A is a plan view of the electrostatic charger 205A. FIG. 4B is a sectional side elevational view taken on line A-A' of FIG. 4A. FIG. 4C is a sectional front elevational view taken on line B-B' of FIG. 4A.

The through-hole 54C is inclined obliquely downward as it extends in the direction toward the first position Q. The through-hole 54C has a rectangular section that is larger than the sectional shape of the operating rod 52. The housing 50 is not provided with the restriction member 57. The operating rod 52 is not formed with the projection 521.

In cleaning the discharge wire 51, that portion of the operating rod 52 which is positioned within the through-hole 54C is constantly inclined obliquely downward as it extends in the direction toward the first position Q, so that the operating rod 52 bends to project toward the bottom surface 56. Therefore, the electrostatic charger 205A prevents the operating rod 52 from coming into contact with the photoreceptor drum 3A and hence fails to damage the surface of the photoreceptor drum 3A.

Figure 5:
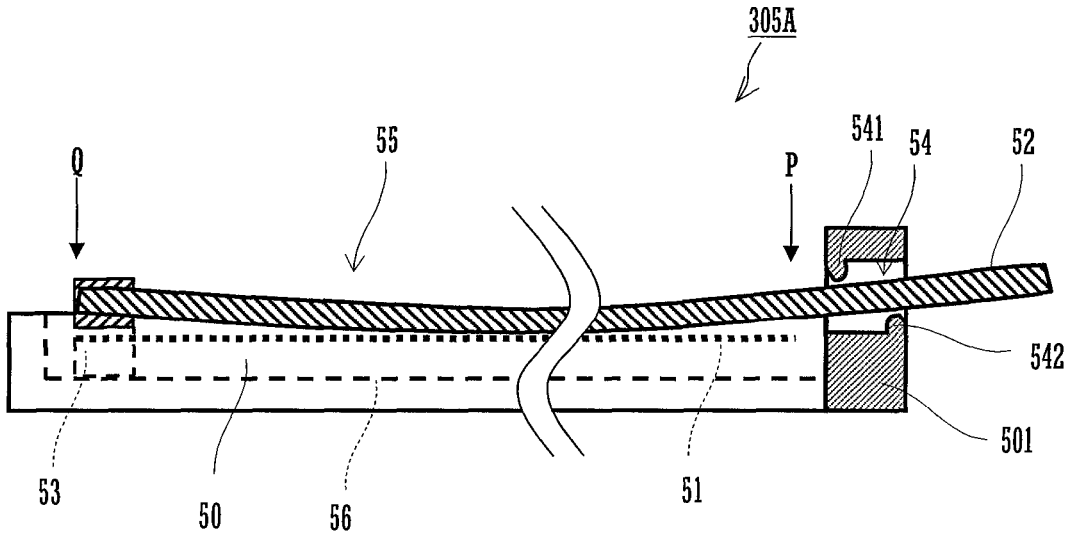
FIG. 5 is a sectional side elevational view of an electrostatic charger device according to a fourth embodiment of the present invention.

Referring to FIG. 5, an electrostatic charger 305A according to a fourth embodiment is different from the electrostatic charger 205A according to the third embodiment in that the electrostatic charger 305A has a through-hole 54D which is different in shape from the through-hole 54C. The following description is directed only to the differences from the electrostatic charger 205A.

The through-hole 54D extends parallel with the axial direction of the photoreceptor drum 3A. The through-hole 54D has a rectangular section that is larger than the sectional shape of the operating rod 52. The though-hole 54B has an internal surface formed with projection 541 (which is equivalent to the "fourth projection" defined by the present invention) which projects from a portion of the internal surface located close to the opening 55 toward the bottom surface 56 side, as well as a projection 542 (which is equivalent to the "fifth projection" defined by the present invention) which projects from a portion of the internal surface spaced away from the opening 55 toward the photoreceptor 3A side.

In cleaning the discharge wire 51, that portion of the operating rod 52 which is positioned within the through-hole 54D is inclined obliquely downward as it extends in the direction toward the first position Q, so that the operating rod 52 bends to project toward the bottom surface 56. Therefore, the operating rod 52 fails to come into contact with the photoreceptor drum 3A and hence fails to damage the surface of the photoreceptor drum 3A.

Figure 6:
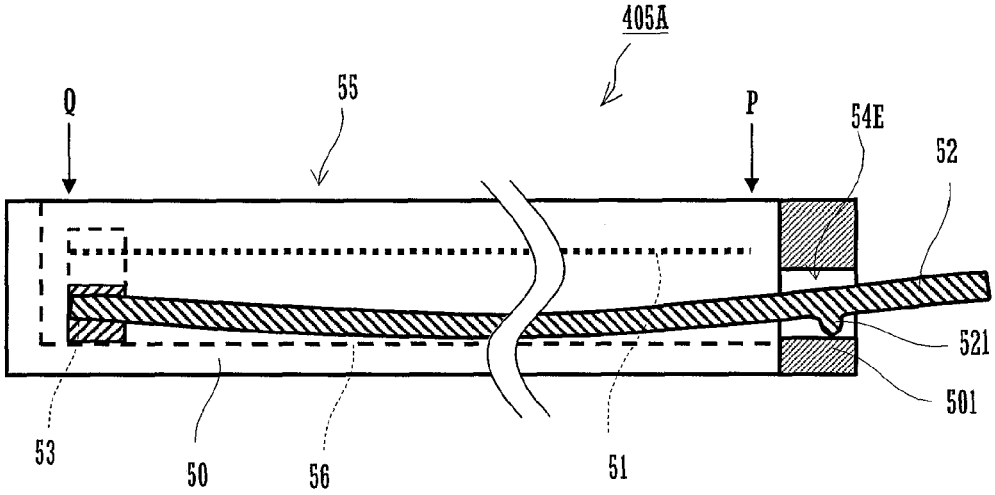
FIG. 6 is a sectional side elevational view of an electrostatic charger device according to a fifth embodiment of the present invention.

Referring to FIG. 6, an electrostatic charger 405A according to a fifth embodiment is different from the electrostatic charger 5A according to the first embodiment in that the electrostatic charger 405A has a through-hole 54E located closer to the bottom surface 56 side and includes the operating rod 52 positioned closer the bottom surface 56 than the discharge wire 51. In cleaning the discharge wire 51, that portion of the operating rod 52 which is positioned within the through-hole 54E when the cleaner member 53 is in the first position Q, is inclined obliquely downward as it extends in the direction toward the first position Q, so that the operating rod bends to project toward the bottom surface 56. When the cleaner member 53 is not in the first position Q, the operating rod 52 fails to bend. Therefore, the operating rod 52 fails to come into contact with the photoreceptor drum 3A and hence fails to damage the surface of the photoreceptor drum 3A.

The electrostatic chargers 105A to 305A may be similar to the electrostatic charger 405A in the feature that each of the through-holes 54B to 54D is located closer to the bottom surface 56 side while the operating rod 52 is positioned closer to the bottom surface 56 than the discharge wire 51.

By inclining the end portion of the operating rod 52 which is located on the cleaner member 53 side, the operating rod 52 can bend to project toward the bottom surface 56 of the housing 50.

Figure 7:
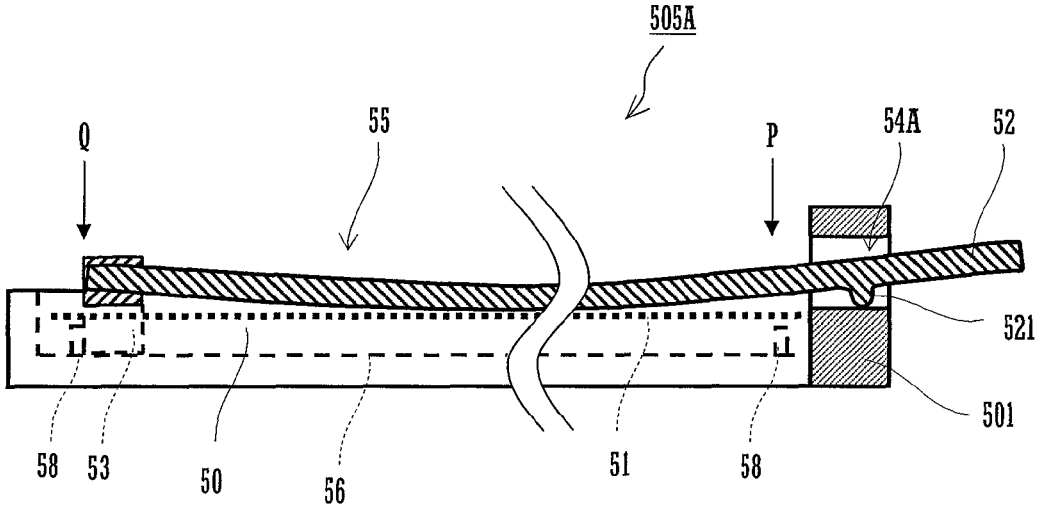
FIG. 7 is a sectional side elevational view of an electrostatic charger device according to a sixth embodiment of the present invention.

Referring to FIG. 7, an electrostatic charger 505A according to a sixth embodiment is different from the electrostatic charger 5A according to the first embodiment in that the discharge wire 51 extends beyond the first position Q and the second position P. The electrostatic charger 505A may be provided with restriction members 58 at the first position Q and the second position P for restricting movement of the cleaner member 53 in the axial direction of the photoreceptor drum 3A.

In any one of the foregoing embodiments, each of the through-holes 54A to 54E may have a circular or polygonal section as long as the section is larger than the sectional shape of the operating rod 52.

The electrostatic charger device according to the present invention is applicable not only to an image forming apparatus having a plurality of electrostatic chargers and an electrostatic pre-charger, but also to an image forming apparatus having at least one electrostatic charger.

The foregoing embodiments should be construed to be illustrative and not limitative of the present invention in all the points. The scope of the present invention is defined by the following claims, not by the foregoing embodiments. Further, the scope of the present invention is intended to include the scopes of the claims and all possible changes and modifications within the senses and scopes of equivalents.

What is claimed is:

1. An electrostatic charger device comprising:

an electrode disposed to face an electrostatic latent image forming surface of an image bearing member and having opposite ends which coincide with opposite ends of the electrostatic latent image forming surface in a primary scanning direction;

a housing having an opening facing the electrostatic latent image forming surface and housing therewithin the electrode stretched in a direction parallel with the primary scanning direction;

a cleaner member having a length in the primary scanning direction for pressing against part of the electrode, the cleaner member being reciprocally movable in the primary scanning direction between a first position and a second position which substantially coincide with the opposite ends of the electrode in the primary scanning direction;

an operating rod having one end in a longitudinal direction to which the cleaner member is fixed;

a guide portion disposed at one end of the housing in the primary scanning direction and having a through-hole extending therethrough in the longitudinal direction, the guide portion supporting the operating rod to enable the cleaner member to reciprocate between the first position and the second position; and a bending member configured to bend the operating rod in such a manner that an intermediate portion of the operating rod projects away from the image bearing member when the cleaner member is in the first position.

2. The electrostatic charger device according to claim 1, wherein the bending member comprises a first projection formed on that portion of the operating rod which is positioned within the through-hole when the cleaner member on the operating rod is in the first position, the first projection projecting in a direction away from the image bearing member.

3. The electrostatic charger device according to claim 1, wherein:

the bending member comprises: a second projection formed on an internal surface of the through-hole which is located on the image bearing member side, the second projection projecting in a direction away from the bearing member; and a third projection formed on that portion of the operating rod which is positioned within the through-hole when the cleaner member on the operating rod is in the first position, the third projection projecting in the direction away from the image bearing member; and the second projection is located closer to the first position than the third projection in the primary scanning direction.

4. The electrostatic charger device according to claim 1, wherein the bending member comprises an internal surface of the through-hole which is inclined in a direction away from the image bearing member as the internal surface extends toward the first position in the primary scanning direction.

5. The electrostatic charger device according to claim 1, wherein:

the bending member comprises: a fourth projection formed on an internal surface of the through-hole which is located on the image bearing member side, the fourth projection projecting in a direction away from the bearing member; and a fifth projection formed on an internal surface of the through-hole which is located on the side opposite to the image bearing member side, the fifth projection projecting toward the image bearing member; and the fourth projection is located closer to the first position than the fifth projection in the primary scanning direction.

6. An image forming apparatus comprising:

an image bearing member configured to bear a toner image thereon; and the electrostatic charger device as recited in claim 1 which is configured to generate an electric field between the image bearing member and the electrostatic charger device by corona discharge.

7. An image forming apparatus comprising:

an image bearing member configured to bear a toner image thereon; and the electrostatic charger device as recited in claim 2 which is configured to generate an electric field between the image bearing member and the electrostatic charger device by corona discharge.

8. An image forming apparatus comprising:

an image bearing member configured to bear a toner image thereon; and the electrostatic charger device as recited in claim 3 which is configured to generate an electric field between the image bearing member and the electrostatic charger device by corona discharge.

9. An image forming apparatus comprising:

an image bearing member configured to bear a toner image thereon; and the electrostatic charger device as recited in claim 4 which is configured to generate an electric field between the image bearing member and the electrostatic charger device by corona discharge.

10. An image forming apparatus comprising:

an image bearing member configured to bear a toner image thereon; and the electrostatic charger device as recited in claim 5 which is configured to generate an electric field between the image bearing member and the electrostatic charger device by corona discharge.

* * * * *